US006941776B2

(12) United States Patent
Jakubowski

(10) Patent No.: US 6,941,776 B2
(45) Date of Patent: Sep. 13, 2005

(54) LOCKING CASE

(76) Inventor: Peter Jakubowski, 18072 Lakepoint La., Huntington Beach, CA (US) 92647

( * ) Notice: Subject to any disclaimer, the term of this patent is extended or adjusted under 35 U.S.C. 154(b) by 0 days.

(21) Appl. No.: 10/360,394

(22) Filed: Feb. 6, 2003

(65) Prior Publication Data

US 2004/0154359 A1 Aug. 12, 2004

(51) Int. Cl.[7] ..... B65D 55/14

(52) U.S. Cl. ..... 70/63; 70/161; 292/341.13; 292/341.18

(58) Field of Search ..... 70/54–56, 63, 70/158–169, 416, 14, 18, 19, 58, 417; 109/49–52, 58, 45; 292/341, 341.11–341.13, 341.18

(56) References Cited

U.S. PATENT DOCUMENTS

| | | | | | |
|---|---|---|---|---|---|
| 518,453 | A | * | 4/1894 | Hollar | 292/2 |
| 522,153 | A | * | 6/1894 | Damon | 109/61 |
| 2,755,748 | A | | 7/1956 | Abell, Jr. | 109/52 |
| 3,146,739 | A | | 9/1964 | Furman | 109/52 |
| 3,369,721 | A | | 2/1968 | Lentz | 224/2 |
| 3,464,606 | A | | 9/1969 | Nordeen | 224/2 |
| 3,994,148 | A | * | 11/1976 | Anderson | 70/58 |
| 4,068,505 | A | * | 1/1978 | Volk, Jr. | 70/56 |
| 4,130,308 | A | * | 12/1978 | Jeavons | 292/216 |
| 4,435,966 | A | * | 3/1984 | Craig | 70/161 |
| 4,468,940 | A | * | 9/1984 | Davis | 70/63 |
| 4,662,664 | A | * | 5/1987 | Wendt et al. | 292/19 |
| 4,788,838 | A | | 12/1988 | Cislo | 70/63 |
| 4,884,420 | A | * | 12/1989 | Finkel et al. | 70/58 |
| 4,890,466 | A | | 1/1990 | Cislo | 70/63 |
| 4,951,982 | A | * | 8/1990 | Sorkilmo | 292/343 |
| 4,961,329 | A | * | 10/1990 | Anderson | 70/2 |
| 4,987,836 | A | | 1/1991 | Owen | 109/52 |
| 5,013,000 | A | * | 5/1991 | Gassaway | 70/58 X |
| 5,035,127 | A | * | 7/1991 | Larsen | 70/56 |
| 5,172,575 | A | | 12/1992 | Fisher | 70/63 |
| 5,236,086 | A | | 8/1993 | MacTaggart | 206/317 |
| 5,375,440 | A | | 12/1994 | Patterson | 70/63 |
| 5,490,697 | A | * | 2/1996 | Surko, Jr. | 292/92 |
| 5,595,417 | A | * | 1/1997 | Thoman et al. | 296/100.09 |
| 5,596,934 | A | * | 1/1997 | Hamm et al. | 109/50 |
| 5,850,796 | A | | 12/1998 | Cislo | 109/51 |
| 5,931,032 | A | * | 8/1999 | Gregory | 70/129 |
| 6,009,731 | A | * | 1/2000 | Emmons | 70/56 |
| 6,082,601 | A | | 7/2000 | Standish | 224/569 |
| 6,151,933 | A | * | 11/2000 | Lentini | 70/159 |
| 6,227,018 | B1 | * | 5/2001 | Miller et al. | 70/58 |
| 6,240,754 | B1 | * | 6/2001 | Petersen | 70/417 |

* cited by examiner

*Primary Examiner*—Suzanne Dino Barrett
(74) *Attorney, Agent, or Firm*—Stetina Brunda; Garred & Brucker

(57) ABSTRACT

A locking case is provided including a base portion and a lid portion rotatably engaged to the base portion. A locking mechanism is mounted on the lid portion and extends therethrough. The locking mechanism includes a cam member having first and second surfaces, and being rotatable to a locked position in response to operation of the locking mechanism. A catch is mounted to the base portion and is disposed proximate the cam first surface when the cam is in the locked position. A reinforcing bracket is mounted to the lid. The reinforcing bracket has a reinforcing flange disposed proximate the cam second surface when the cam is disposed in the locked position.

19 Claims, 3 Drawing Sheets

LOCKING CASE

CROSS-REFERENCE TO RELATED APPLICATIONS (Not Applicable)

STATEMENT RE: FEDERALLY SPONSORED RESEARCH/DEVELOPMENT (Not Applicable)

BACKGROUND OF THE INVENTION

The present invention relates to locking cases, and more particularly reinforced locking cases useful to secure pistols, weapons, and other dangerous or valuable products.

Many cases exist to secure weapons, dangerous products or other articles. Such cases are commonly used by police officers or hunters having a need to safely store and transport weapons. A police officer may, for example, need to store a weapon in an unattended vehicle. Hunters or shooting enthusiasts may similarly need to safely secure a weapon for home storage, or transportation.

Existing cases for storing, guns and other valuables are generally suited for their intended purposes. However, they may include deficiencies which detract from their overall effectiveness. Simple lock boxes are typically formed as a case with a pivoting top, with a key or combination lock engaging the top to the case. The lock may typically include a rotating cam that engages a catch to secure the two pieces together when locked. However, in conventional cases the base and top may be separated by means of a prying tool or the like, which displaces the cam from the catch, allowing the top to open. Young children may even be capable of so defeating the locking mechanism and gaining access to weapons or other contents in the case. This presents grave safety hazards as well as liability exposure in the event that damage or injury results.

Different types of locking mechanisms may be used to enhance the security of the case. In some cases the existing lock cylinder may be replaced by a more sturdy lock cylinder that provides a higher degree of safety against picking the lock or other vulnerabilities. However, efforts to so upgrade existing locking mechanisms are frequently limited by the fixed construction of the catch and other portions of the case. For example, substitution of a more secure lock mechanism, having a longer length, may result in the cam moving to a locking position spaced too far from the catch that it is intended to engage. The case may therefore be opened a certain amount before the cam engages the catch, allowing the prying tool to be more easily used to break the lock open.

Another security enhancement feature found in some contemporary cases is the inclusion of a reinforcing member disposed distal to the cam when it is in the locking position. The reinforcement member opposes bending of the cam to prevent prying the case open. Consequently, the cam remains captured between the catch and the reinforcing member to provide additional security against unauthorized openings.

Use of such reinforcement members is a useful enhancement to security of the case. However, the reinforcement members are generally mounted in a fashion that presupposes the cam remain at a fixed location proximate the catch. Consequently, efforts to upgrade the locking mechanism to one having a different length cylinder would not be compatible with fixed catch and/or fixed reinforcement members.

Accordingly, a need exists to provide a locking case that allows for use of alternate locking mechanisms while still allowing for secure engagement to the catch, and allowing the use of a reinforcement member to oppose prying the case open.

BRIEF SUMMARY OF THE INVENTION

A locking case is provided including a base portion and a lid portion rotatably engaged to the base portion. A locking mechanism is mounted on the lid portion and extends therethrough. The locking mechanism includes a cam member having first and second surfaces, and being rotatable to a locked position in response to operation of the locking mechanism. A catch is mounted to the base portion and is disposed proximate the cam first surface when the cam is in the locked position. A reinforcing bracket is mounted to the lid. The reinforcing bracket has a reinforcing flange disposed proximate the cam second surface when the cam is disposed in the locked position.

In the presently preferred embodiment the catch accommodates a plurality of spacers engaged to the catch in stacked relation to variably mitigate spacing between the catch and the cam first surface.

A plurality of reinforcing spacers may also be mounted upon the reinforcing bracket in stacked relation to variably mitigate spacing between the reinforcing flange and the cam second surface.

Accordingly, the locking case is adaptable for use in conjunction with a variety of different locking mechanisms, which may have different lengths. As the locking mechanism extends further into the case, fewer reinforcing spacers may be used, but more catch spacers, to maintain the cam in substantially abutting relation with both the reinforcing spacers and catch spacers. In such case, the catch flange and reinforcing flange may be spaced ¼ inch to 1 inch or more apart to accommodate relocation of the cam in different locking mechanisms. The flanges may similarly be formed of different thicknesses, in accordance with the general size of the locking case. In one embodiment the spacers are formed to be approximately ⅛ to 1/32 of an inch thick.

The lid and case may further be provided with apertures, disposed substantially proximate each other, in order to allow the use of a secondary locking mechanism with the case. In such a construction, a padlock may be inserted through the apertures to further lock the case and lid together, providing enhanced security for the contents therein.

BRIEF DESCRIPTION OF THE DRAWINGS

These as well as other features of the present invention will become more apparent upon reference to the drawings wherein.

DETAILED DESCRIPTION OF THE INVENTION

The description set forth below, in conjunction with the accompanying drawings represents the presently preferred embodiments of the present invention. Accordingly, the description is intended to explain the illustrated constructions, but is not intended to preclude additional constructions or alternate embodiments of the invention. Moreover, as will be apparent to those of ordinary skill in the art, the mechanisms and structural elements described and illustrated herein may be replaced by alternate and equivalent constructions as may be appropriate for different applications. As such, alternate locking mechanisms and case components may be substituted as desired without departing from the broader spirit and scope of the invention as set forth herein.

Figure 1:
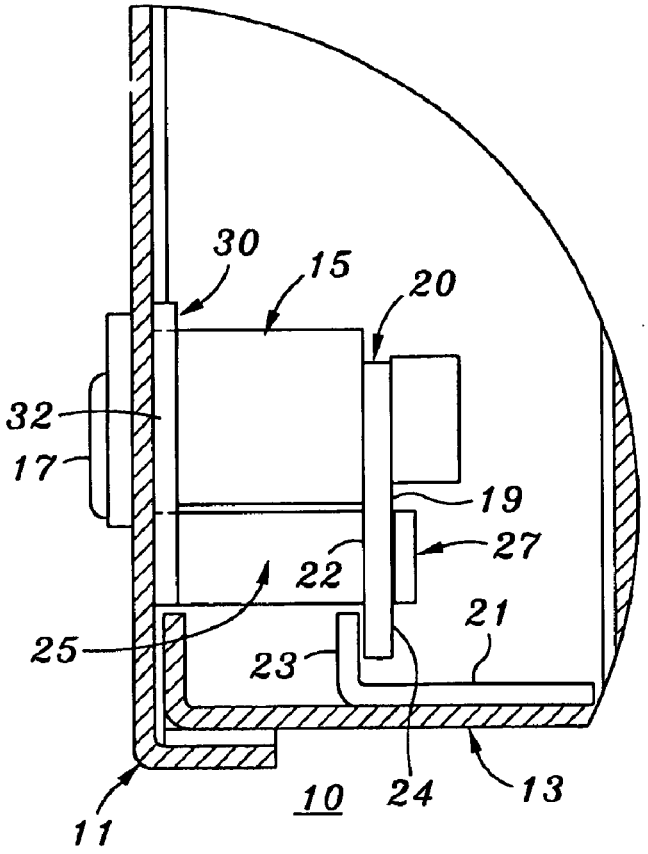
FIG. 1 is a partial sectional view of an exemplary locking case in accordance with the present invention.

Referring to FIG. 1 in the drawings, one presently preferred embodiment of the invention is disclosed. As shown therein, locking case 10 includes a first portion 11 and a second portion 13, which may be implemented as a cover and base respectively. A locking mechanism 15 is mounted on the cover 11 and extends therethrough. A key receiving member 17 allows insertion of a key into the locking mechanism which can rotate the locking cam 19 between a locked and unlocked position.

Catch 21 is secured to base 13 and defines a catch flange 23 which is disposed in substantially abutting relation to first surface 22 of cam 19, when cam 19 is rotated to the locked position. Reinforcing bracket 30 is secured to the cover 11. The reinforcing bracket 30 includes flange 25 which extends from the cover 11 beyond the cam 20, terminating in the reinforcing flange 27. The reinforcing flange 27 is disposed in substantially abutting relation to second surface 24 of cam 19, when cam 19 is rotated to the locked position.

Accordingly, as the locking mechanism is moved to the locked position, cam 19 is extended intermediate catch flange 23 of the catch 21 and reinforcing flange 27 of the reinforcing bracket 30. Any effort to open the case will therefore cause the cam 19 to stop against the catch 21. Should efforts be made to pry the case open, the cam 19 will be urged to also rest against the reinforcing flange 27, thereby opposing any prying open of the case.

In the presently preferred embodiment the reinforcing bracket 30 may be formed to have an annular aperture to receive the locking mechanism 15. However, other means of mounting the reinforcing bracket may be implemented within the broader scope of the invention. Similarly, locking mechanism 15 may be implemented by alternate types of locks, such as combination locks or the like, rather than keyed locks as shown at FIG. 1.

Figure 2:
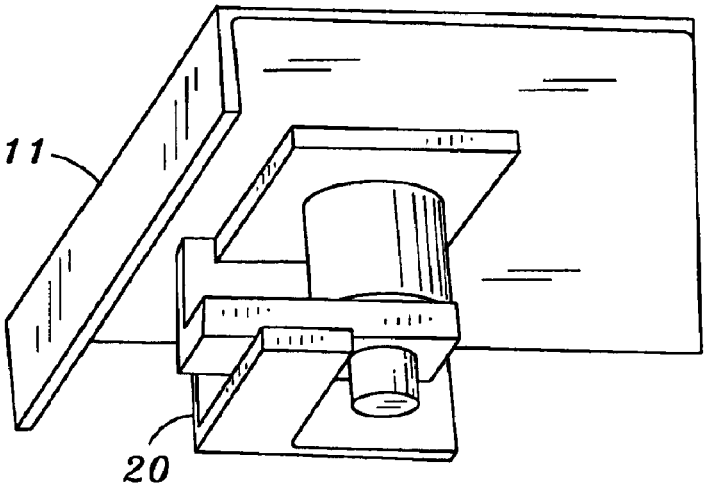
FIG. 2 is a perspective view of the locking case shown at FIG. 1.

FIG. 2 provides a perspective view of the locking mechanism of FIG. 1, as mounted on the lid 11. It is to be understood, however, that the locking mechanism may alternately be disposed on the base, e.g. on the side of the base, with the catch disposed on the lid.

Figure 3:
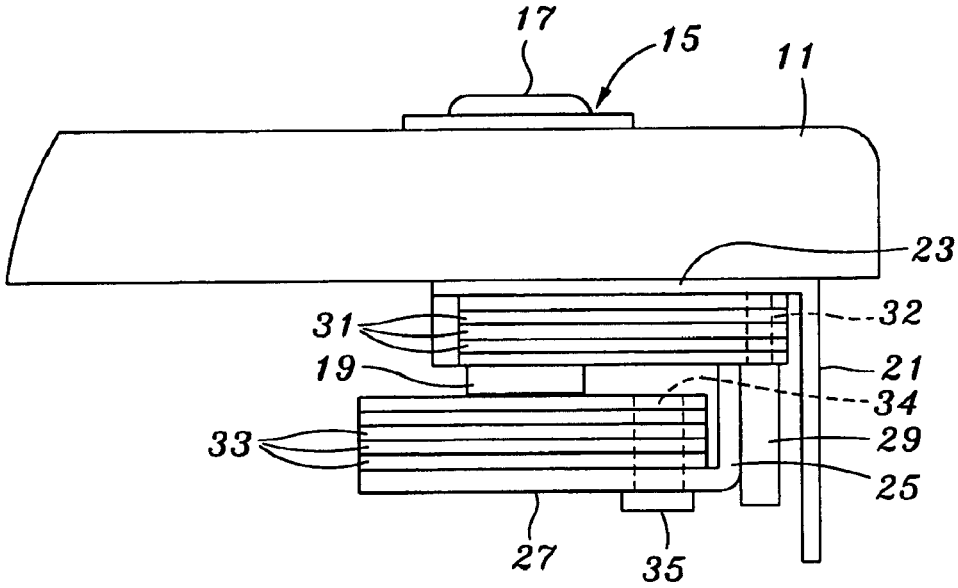
FIG. 3 is a sectional view of a locking case compatible with an adjustable length locking mechanism.

FIG. 3 is a sectional view showing the locking case in accordance with another feature of the present invention. As with the construction set forth above, the construction includes locking mechanism 15 mounted to lid 11, including a cam 19 that relocates with the key action in the locking mechanism. Again, the construction also includes a reinforcing bracket including a flange 25 and a reinforcing flange 27. Catch 21 also remains, including catch flange 23.

The construction of FIG. 3, however, also includes a series of spacers, including catch spacers 31 and reinforcing spacers 33 The catch spacers 31 are mountable upon post 29, which extends through apertures 32, formed in spacers 31. The reinforcing member spacers 33 are similarly mounted upon post 35, which extends through apertures 34, formed in spacers 33.

The inclusion of the catch spacers 31 and reinforcing member spacers 33 allow the locking case to be utilized in conjunction with locks having different lengths. For example, where the locking mechanism is longer, such that cam 19 is more spaced from the lid, fewer reinforcing member spacers would be utilized and more catch spacers would be utilized. Nonetheless, the cam still remains in substantially abutting contact with the uppermost reinforcing member spacer, and the lowermost catch spacer. As will be apparent to those of one of ordinary skill in the art, the present invention therefore allows for a locking mechanism for a locking case that may accommodate different types of locks, as may be desired by a user.

Figure 4:
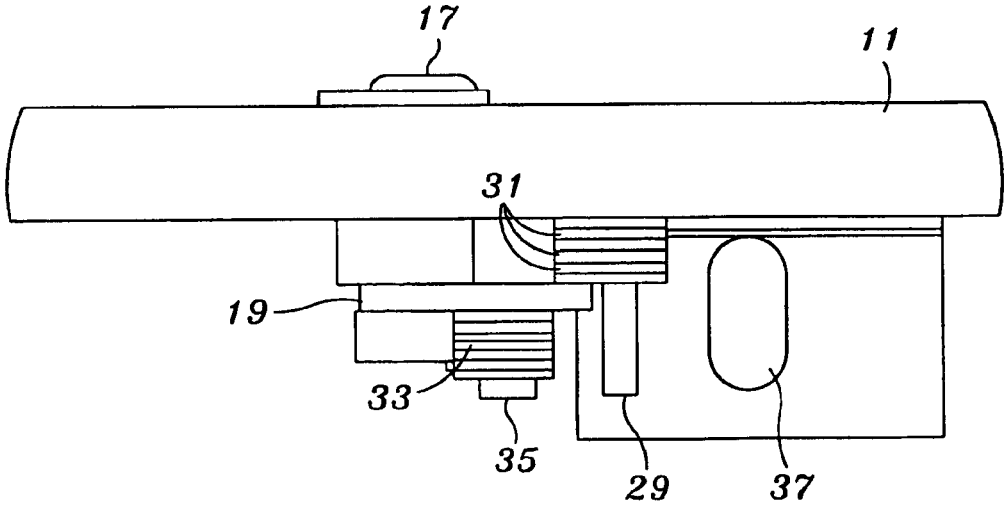
FIG. 4 is another sectional view of the locking case shown at FIG. 3.

FIG. 4 provides an alternate view of the construction set forth in FIG. 3. Again, the cam 19, shown in the locking position, is disposed proximate the catch spacers 31 and the reinforcing member spacers 33.

As will be apparent to one of ordinary skill in the art, the particular construction of the catch spacers and the reinforcing member spacers, may be a matter of design choice, provided that the catch spacers are located to abut against the cam upper surface when it is in the locking position, and the reinforcing member spacers abut the lower surface cam, but do not impede opening of the case when the cam is in the unlocked position.

Figure 5:
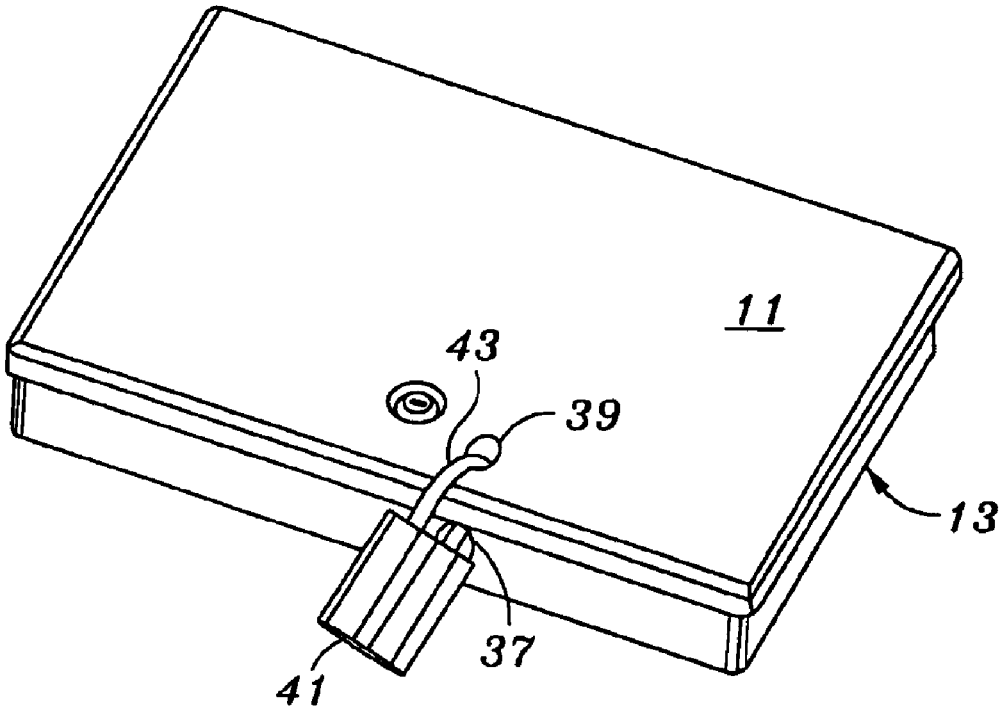
FIG. 5 is a perspective view of a locking case compatible with a secondary locking mechanism.

As shown at FIGS. 4 and 5 the locking case can accommodate a secondary locking mechanism, in addition to that described above. In this embodiment apertures 37, 39 are formed in the base and lid respectively. A pad lock 41 may therefore engage the case by extending locking arm 43 through apertures 37 and 39. In accordance with such a construction, the case is further secured against unintended access to its contents.

As indicated above, alternate embodiments of the invention may be implemented without the departing from the broader spirit and scope of the novel aspects described herein. The secondary locking mechanism, for example, may be implemented by means of a flange extending vertically from the base of the locking case through the cover, including a lock receiving aperture formed therein. In such a construction, a pad lock may be extended through the aperture, effectively precluding the lid from being separated from the base, to which the flange is secured. Also, the spacers may be mounted to the catch flange or the reinforcement flange in alternate ways, while retaining the same functionality, as described above.

What is claimed is:

1. A locking case comprising:

a. a base portion;

b. a lid portion rotatably engaged to the base portion;

c. a locking mechanism mounted on the lid portion and extending therethrough, the locking mechanism including a cam member having opposing first and second surfaces and rotatable to a locked position in response to operation of the locking mechanism;

d. a catch mounted to the base portion, the catch being disposed proximate the cam first surface when the cam is disposed in the locked position;

e. a reinforcing bracket mounted to the lid, the reinforcing bracket having a reinforcing flange disposed proximate the cam second surface when the cam is disposed in the locked position; and f. at least one catch spacer engagable to the catch between the catch and cam member first surface to variably mitigate spacing between the catch and the cam first surface.

2. A locking case as recited in claim 1 further including a plurality of catch spacers selectively engagable to the catch in stacking relation to variably, mitigate spacing between the catch and the cam first surface.

3. A locking case as recited in claim 2 further including a plurality of reinforcing spacers engagable to the reinforcing bracket in stacking relation to variably mitigate spacing between the reinforcing flange and the cam second surface.

4. A locking case as recited in claim 3 further including a catch post secured to the catch and extending therefrom, the catch spacers being stackable on the catch post.

5. A locking case as recited in claim 4 further including a reinforcing member post secured to the reinforcing bracket, the reinforcing spacers being stackable on to the reinforcing member post.

6. A locking case as recited in claim 1 wherein the locking mechanism comprises a key operated locking mechanism.

7. A locking case as recited in claim 3 wherein the base portion and the lid portion are each provided with a secondary lock receiving aperture to facilitate locking engagement of the base portion and the lid portion.

8. A locking case as recited in claim 1 further including at least one reinforcing spacer engagable to the reinforcing bracket to mitigate spacing between the reinforcing flange and the cam second surface.

9. A locking case as recited in claim 1 further including at least one reinforcing spacer engagable to the reinforcing bracket between the reinforcing bracket and the cam second surface to mitigate spacing between the catch and the cam first surface.

10. A locking case as recited in claim 1, wherein the catch opposes movement of the cam towards the catch, and the reinforcing bracket opposed movement of the cam away from the catch.

11. A locking case comprising:

a. a base portion;

b. a lid portion rotatably engaged to the base portion;

c. a locking mechanism mounted on the lid portion and extending therethrough, the locking mechanism including a cam member having opposing first and second surfaces and rotatable to a locked position in response to operation of the locking mechanism;

d. a catch mounted to the base portion, the catch being disposed proximate the cam first surface when the cam is disposed in the locked position;

e. a reinforcing bracket mounted to the lid, the reinforcing bracket having a reinforcing flange disposed proximate the cam second surface when the cam is disposed in the locked position; and f. at least one reinforcing spacer engagable to the reinforcing bracket between the reinforcing bracket and cam member second surface to variably mitigate spacing between the reinforcing flange and the cam second surface.

12. A locking case as recited in claim 11 further including at least one catch spacer engagable to the catch to mitigate spacing between the catch and the cam first surface.

13. A locking case as recited in claim 11 further including a plurality of catch spacers engagable to the catch in stacking relation to variably mitigate spacing between the catch and the cam first surface.

14. A locking case as recited in claim 11 further including a plurality of reinforcing spacers selectively engagable to the reinforcing bracket in stacking relation to variably mitigate spacing between the reinforcing flange and the cam second surface.

15. A locking case as recited in claim 13 further including a catch post secured to the catch and extending therefrom, the catch spacers being stackable on the catch post.

16. A locking case as recited in claim 14 further including a reinforcing member post secured to the reinforcing bracket, the reinforcing spacers being stackable on to the reinforcing member post.

17. A locking case as recited in claim 11 wherein the locking mechanism comprises a key operated locking mechanism.

18. A locking case as recited in claim 11 wherein the base portion and the lid portion are each provided with a secondary lock receiving aperture to facilitate locking engagement of the base portion and the lid portion.

19. A locking case as recited in claim 11, wherein the catch opposes movement of the cam towards the catch, and the reinforcing bracket opposed movement of the cam away from the catch.

* * * * *